United States Patent [19]

Cloup

[11] 4,091,700

[45] May 30, 1978

[54] PRESS-HEAD

[76] Inventor: Jean Cloup, 33360 Latresne, France

[21] Appl. No.: 764,961

[22] Filed: Feb. 2, 1977

[30] Foreign Application Priority Data

Feb. 2, 1976 France ..... 76 02774

[51] Int. Cl.[2] ..... B26F 1/04; B26D 7/06

[52] U.S. Cl. ..... 83/140; 83/132; 83/528; 83/549; 83/572

[58] Field of Search ..... 83/132, 138, 140, 528, 83/549, 572, 136, 137, 143; 234/114

[56] References Cited

U.S. PATENT DOCUMENTS

| | | | |
|---|---|---|---|
| 1,728,475 | 9/1929 | Cavill | 83/549 X |
| 2,704,125 | 3/1955 | Taylor | 83/137 |
| 3,685,380 | 8/1972 | Daniels | 83/534 X |

*Primary Examiner*—Willie G. Abercrombie

[57] ABSTRACT

A press-head comprising a plurality of punches and stripping members, wherein at least one of the punches may be directly connected to the head of the press for the machining operation, while the other punches and the stripping members abut via an elastic means on said head so that, on either side of the active punch in the process of machining, when the head is descending, at least one punch is used as stripping member selectively with a stripping member or a punch used as stripping member.

5 Claims, 4 Drawing Figures

24
23
11
22
20
21
29
27
26
12
28
29
27a
26a
18
17
13
14a

PRESS-HEAD

The present invention relates to a press-head comprising a plurality of punches with mutual stripping.

Press-heads used in particular for stamping holes in sheet metal by means of punches require the use of two stripping members elastically mounted on the head and disposed on either side of the punch in order to abut on the sheet metal under the action of the elastic members, during penetration of said punch and to enable the sheet metal to be held on the die when the punch is being withdrawn.

This arrangement is suitable when only one punch, or punches of which the distance between their axes is sufficient to allow several stripping members to be disposed between the punches, are used; however, this becomes virtually impossible when several punches are used which are so disposed that the distance between axes is short.

It is an object of the invention to remedy this drawback.

To this end, the present invention relates to a press-head comprising a plurality of punches, wherein at least one of the punches may be connected directly to the head of the press for the machining operation, whilst the other punches and the stripping members abut, via an elastic means, on said head so that, on either side of the active punch in the process of machining, when the head is descending, at least one punch is used as stripping member selectively with a stripping member or a punch used as stripping member.

The device according to the invention therefore enables punches to be used which are very close to one another, disposed in particular in line with two stripping members at the ends. This very simple arrangement therefore enables the problem to be solved with a minimum of means and at a relatively inexpensive cost.

The invention will be more readily understood on reading the following description with reference to the accompanying drawings, in which:

FIG. 1 schematically shows an embodiment of an improved press-head according to the invention;

Figure 1:
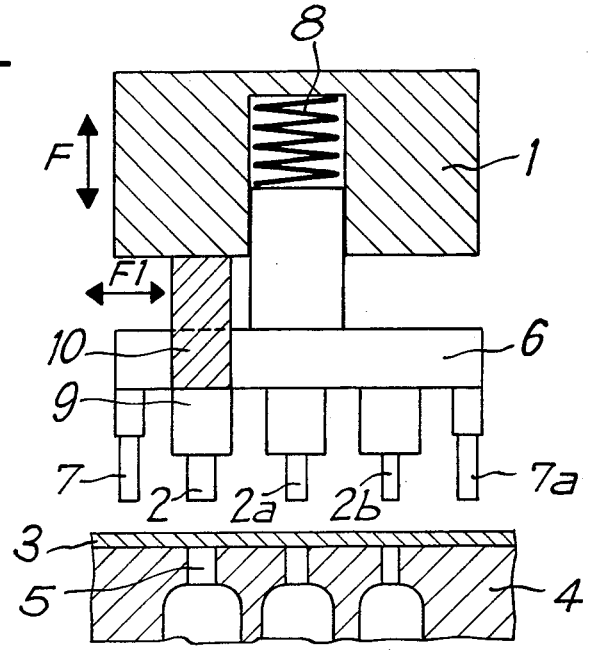

Referring now to the drawings, FIG. 1 shows a press-head 1 which is animated, in known manner, by a reciprocating movement in the two directions of arrow F, said head being provided with punches 2, **2*a*, 2*b* disposed above a sheet of metal 3 in which it is desired to make holes by means of said punches, said sheet metal 3 resting on a table 4 perforated with holes 5** corresponding to the punches.

In accordance with the invention, the punches 2, **2*a*, 2*b* abut by the central part of their shank 9 on a slide 6 fast at its two ends with stripping members 7, 7*a*, said slide itself being in abutment, via an elastic member constituted by a spring 8, against the press-head 1. The end parts of the shank 9 of the punches 2, 2*a*, 2*b* may be selectively and positively connected to the press-head via a crosspiece 10 mounted to slide in the direction of arrow F1 perpendicularly to the axis of the punches and which may be interposed between shank 9 of the punches and the press-head 1**.

To cut a hole in the sheet metal by means of punch 2, the cross-piece 10 is brought between the press-head 1 and the shank 9 of the punch 2. When the press-head 1 is descending, all the punches 2, **2*a*, 2*b* and the stripping members are taken along until they come into contact with the sheet metal 3; however, due to the connection of the slide 6 with the elastic member 8, the punches 2*a*, 2*b* and the stripping members 7, 7*a* simply abut elastically on the surface of the sheet metal 3 whilst the punch 2 positively connected to the press-head 1 via crosspiece 10 penetrates into the sheet metal and shears a hole therein under the action of the press-head. Whilst the punch 2 is being withdrawn, the stripping member 7 and the punch 2*a* located on either side of the punch 2 are in abutment on the sheet metal under the action of the spring 8 and ensure the withdrawal of the punch 2 whilst maintaining the sheet metal 3 in contact with table 4**.

Figure 3:
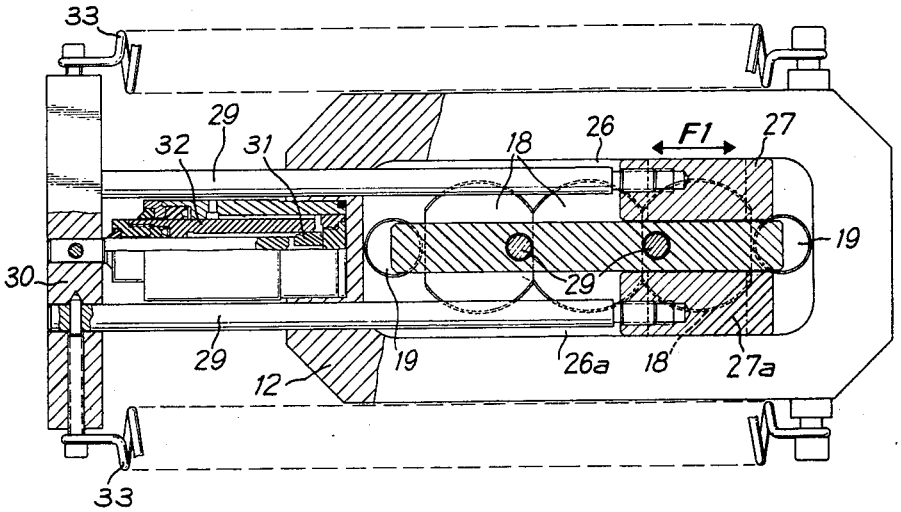
FIG. 3 is a section along line III—III of FIG. 2.
Figure 2:
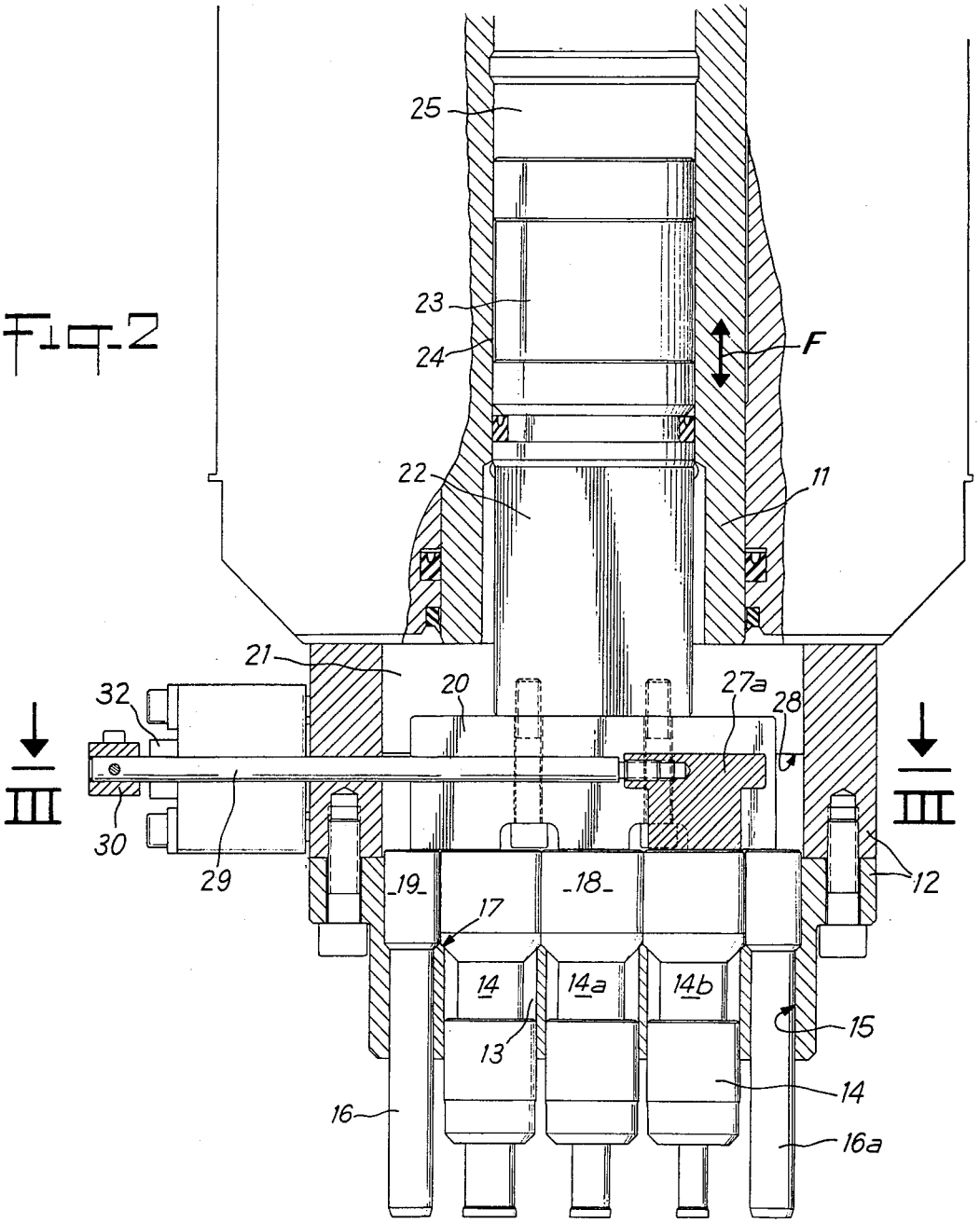
FIG. 2 is a view in elevation and in partial section of another embodiment of the press-head.
Figure 4:
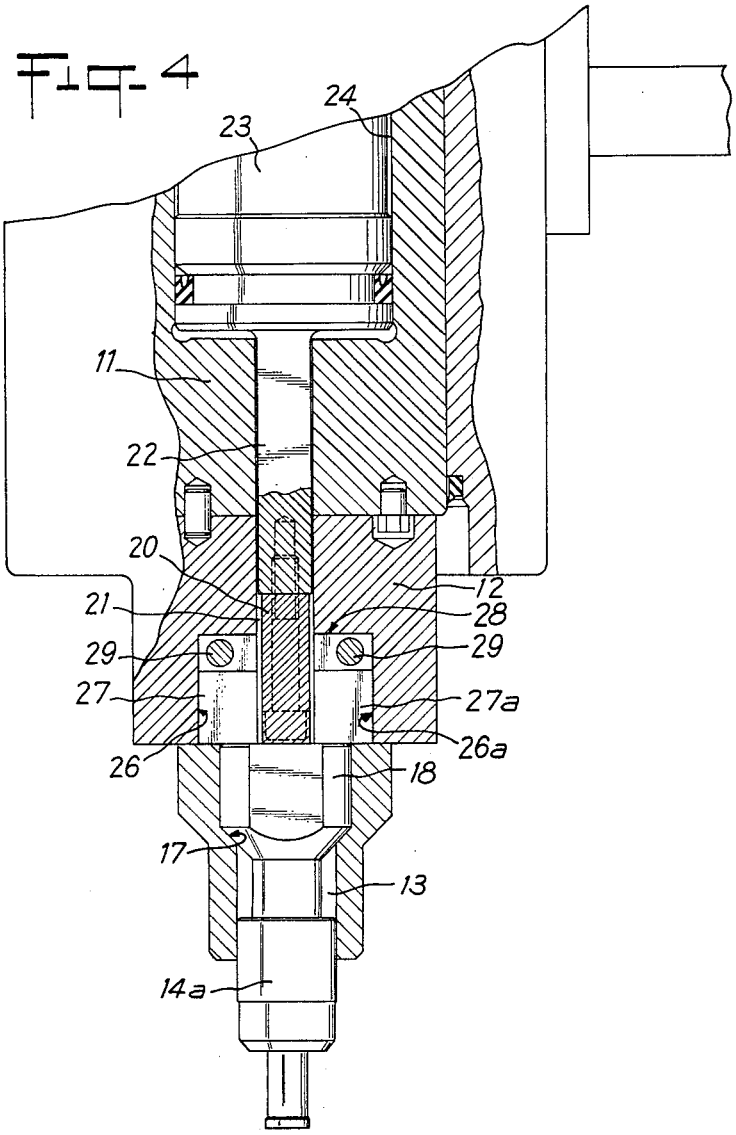
FIG. 4 is a view in elevation and in side section of the press-head shown in FIG. 2.

FIGS. 2, 3 and 4 show another embodiment of the invention which comprises a head 11 moving in the two directions of arrow F and on which is screwed a base 12 composed of several elements having bores 13 in which are engaged punches 14, **14*a*, 14*b* and bores 15 in which are engaged stripping members 16, 16*a* disposed at the two ends of the row of punches. Said punches 14, 14*a*, 14*b* and stripping members 16, 16*a* abutting on shoulders 17 provided on the base 12. The shank 18 of the punches 14 and the shank 19 of the stripping members 16 abutting in their central part against a slide 20 mounted to slide in a central housing 21 and connected by a connecting member 22 to a piston 23 moving in a cylinder 24 machined in the press-head 11 and filled with a hydraulic fluid acting on one of the faces of the piston 23** in the manner of an elastic member.

At the base of the central housing 21 and on either side of the longitudinal axis thereof are provided two lateral housings 26, **26*a* in which two elements 27, 27*a* of a crosspiece, which may be selectively and positively interposed between the punches 14, 14*a*, 14*b*, are mounted to slide in the direction of arrow F1 perpendicularly to the axes of the punches. The crosspiece elements 27, 27*a* abut on one side on the ends of the shank 18 of the punches 14, 14*a*, 14*b* and the shoulder 28 of the press-head in order positively to connect the press-head and one of the punches. The elements 27, 27*a* are connected by sliding rods 29 with a transverse bar 30 with a piston rod 31 of a jack 32, said bar 30 being subjected at its ends to the action of return springs 33 fixed to a screw 34 fast with the base 12**.

To make a hole in sheet metal by means of one of the punches, particularly punch **14*b* (FIGS. 2,3,4), the crosspiece elements 27, 27*a* are brought above the shank 18 of the punch 14*b* by action on the piston 31 and returned by springs 33. In this way, the punch 14*b* is made fast with the press-head 11 by means of the crosspiece elements 27, 27*a* whilst the other punches 14, 14*a* and the stripping members 16, 16*a* abut via the slide 20 on the piston 23 which compresses the fluid 25** in the manner of an elastic member.

When the press-head 11 descends, only the punch **14*b* will be driven positively and will effect the machining operation on the workpiece, the other punches 14, 14*a*** and the stripping members coming into contact elastically with the surface of the sheet metal workpiece.

When the punch **14*b* is withdrawn by the press-head being raised, the punch 14*a* and the stripping member 16*a*** ensures that the workpiece is held against its stamping support.

If punch 14a is used for stamping, punches 14 and 14b act as stripping members.

What is claimed is:

1. A reciprocally movable press-head comprising a plurality of punches and mutual stripping members, said stripping members functioning as strippers, with one of said punches functioning as a metal cutting punch and at least one other of said punches functioning as a stripper, said metal cutting punch being positioned between two strippers with at least one of said strippers being one of said other punches, said strippers being elastically mounted relative to said metal cutting punch.

2. A press head as defined in claim 1, wherein the shank of the punches abuts in its central part on a slide itself in abutment on the elastic means connected to the press-head, the two end parts of the shank of the punches being adapted to be connected selectively and positively to the press-head by a crosspiece mounted to slide perpendicularly to the axis of the punches and adapted to be interposed directly between the shank of the punches and the press-head.

3. A press head as defined in claim 1, wherein the elastic means is constituted by an enclosure made in the head and filled with a fluid acting on one of the faces of a piston which is fixed on the slide against which the central part of the shank of the punches abuts.

4. A press head as defined in claim 1, wherein the elastic means is constituted by a spring interposed between the press-head and the slide in abutment on the central part of the shank of the punches.

5. A press-head as defined in claim 1, further comprising a central opening in which is slidably mounted the slide connected to the piston of the elastic means and to the central part of the shanks of the punches, said opening being provided at its base, on either side of its axis, with two lateral housings in which the two elements of the crosspiece which are connected by at least one rod sliding in the body of the head to a control means, move perpendicularly to the axes of the pistons.

* * * * *